US009534375B2

(12) United States Patent
Hatzinikolas

(10) Patent No.: US 9,534,375 B2
(45) Date of Patent: Jan. 3, 2017

(54) WALL TIE APPARATUS AND METHOD

(71) Applicant: Michael Hatzinikolas, Edmonton (CA)

(72) Inventor: Michael Hatzinikolas, Edmonton (CA)

( * ) Notice: Subject to any disclaimer, the term of this patent is extended or adjusted under 35 U.S.C. 154(b) by 0 days.

(21) Appl. No.: 14/052,478

(22) Filed: Oct. 11, 2013

(65) Prior Publication Data

US 2014/0174014 A1 Jun. 26, 2014

Related U.S. Application Data

(60) Continuation-in-part of application No. 13/240,930, filed on Sep. 22, 2011, now Pat. No. 8,555,595, which is a division of application No. 11/554,207, filed on Oct. 30, 2006, now Pat. No. 8,051,621.

(51) Int. Cl.

| | |
|---|---|
| ***E04B 2/06*** | (2006.01) |
| ***E04B 1/41*** | (2006.01) |
| ***E04G 21/18*** | (2006.01) |
| *E04B 1/76* | (2006.01) |

(52) U.S. Cl.

CPC ..... *E04B 1/4178* (2013.01); *E04B 2/06* (2013.01); *E04G 21/185* (2013.01); *E04B 1/7616* (2013.01)

(58) Field of Classification Search

CPC ..... E04B 2/06; E04B 1/4178; E04B 1/7616; E04G 21/185

USPC ..... 52/712–715, 698, 700, 701, 378–379, 52/562, 565, 568, 426, 513, 383, 434

See application file for complete search history.

(56) References Cited

U.S. PATENT DOCUMENTS

| | | | | |
|---|---|---|---|---|
| 543,014 | A | 7/1895 | Hanna | |
| 750,595 | A | 1/1904 | Campbell | |
| 1,324,537 | A | 12/1919 | Belcher | |
| 1,818,299 | A | 8/1931 | Bowman | |
| 1,832,231 | A | 11/1931 | Menninger | |
| 1,924,724 | A | 8/1933 | Olney | |
| 2,021,742 | A * | 11/1935 | Nichols | F27D 1/004 52/506.03 |
| 2,097,069 | A | 10/1937 | Klages | |
| 2,261,510 | A | 11/1941 | Atcheson | |
| 2,293,743 | A | 8/1942 | Miles et al. | |
| 2,636,156 | A | 11/1944 | Sinner et al. | |
| 2,860,504 | A | 11/1958 | Sinner et al. | |
| 3,217,457 | A | 11/1965 | Naar | |
| 3,234,702 | A | 2/1966 | Zibell | |
| 3,309,828 | A * | 3/1967 | Tribble | E04B 2/10 52/426 |

(Continued)

FOREIGN PATENT DOCUMENTS

| | | |
|---|---|---|
| AT | 188895 A | 2/1957 |
| CA | 1294457 | 1/1992 |

(Continued)

*Primary Examiner* — Jeanette E Chapman

(74) *Attorney, Agent, or Firm* — Kenneth L. Bousfield; Bereskin & Parr LLP/S.E.N.C.R.L., s.r.l.

(57) ABSTRACT

A tie system is provided for use with a wall form for a cementitious backup wall and for use with a wall tie to connect between the cementitious backup wall and a veneer. The tie system includes a backup wall connector and a form connector. The form connector is connectable to the form and secures the backup wall connector in position as the wall form is filled. The connector may have heat transfer reducing perforations. The connector may have an outwardly positioned flange to which external wall members may be attached. The connector may have multiple gap-setting features.

18 Claims, 9 Drawing Sheets

(56) References Cited

U.S. PATENT DOCUMENTS

| | | | | |
|---|---|---|---|---|
| 3,319,983 | A | 5/1967 | Zibell | |
| 3,342,005 | A | 9/1967 | Rickards et al. | |
| 3,350,830 | A | 11/1967 | Smith, Jr. et al. | |
| 3,353,312 | A | 11/1967 | Storch | |
| 3,450,427 | A | 6/1969 | Fischer | |
| 3,842,554 | A | 10/1974 | Swick | |
| 3,984,077 | A | 10/1976 | Shine | |
| 4,076,203 | A | 2/1978 | McDonnell | |
| 4,107,887 | A | 8/1978 | Wendt | |
| 4,150,808 | A | 4/1979 | Sawyer | |
| 4,223,501 | A * | 9/1980 | DeLozier | 52/309.12 |
| 4,223,505 | A | 9/1980 | Krebel et al. | |
| 4,329,821 | A | 5/1982 | Long et al. | |
| 4,373,314 | A | 2/1983 | Allan | |
| 4,429,850 | A | 2/1984 | Weber et al. | |
| 4,523,413 | A | 6/1985 | Koppenberg | |
| 4,631,888 | A | 12/1986 | Palmans | |
| 4,799,643 | A | 1/1989 | Shepard | |
| 4,843,776 | A | 7/1989 | Guignard | |
| 4,869,038 | A | 9/1989 | Catani | |
| 4,869,043 | A * | 9/1989 | Hatzinikolas et al. | 52/712 |
| 5,207,043 | A | 5/1993 | McGee et al. | |
| 5,265,396 | A | 11/1993 | Amimoto | |
| 5,283,992 | A | 2/1994 | Morassutti | |
| 5,292,581 | A | 3/1994 | Viazmensky et al. | |
| 5,392,581 | A * | 2/1995 | Hatzinikolas et al. | 52/712 |
| 5,490,366 | A | 2/1996 | Burns et al. | |
| 5,619,834 | A | 4/1997 | Chen | |
| 5,671,578 | A | 9/1997 | Hohmann | |
| 5,816,008 | A | 10/1998 | Hohmann | |
| 5,860,257 | A | 1/1999 | Gerhaher et al. | |
| 6,055,787 | A | 5/2000 | Gerhaher et al. | |
| 6,098,364 | A | 8/2000 | Liu | |
| 6,128,883 | A * | 10/2000 | Hatzinikolas | 52/698 |
| 6,131,360 | A | 10/2000 | Dalen | |
| 6,164,029 | A | 12/2000 | Lee | |
| 6,209,281 | B1 * | 4/2001 | Rice | 52/714 |
| 6,279,283 | B1 | 8/2001 | Hohmann et al. | |
| 6,484,465 | B2 | 11/2002 | Higgins | |
| 6,503,558 | B2 | 1/2003 | Williamson | |
| 6,574,936 | B1 | 6/2003 | Anderson, Sr. | |
| 6,598,362 | B2 | 7/2003 | Hikai | |
| 6,729,080 | B1 | 5/2004 | Zambelli et al. | |
| 6,792,727 | B2 | 9/2004 | Krieger | |
| 6,851,239 | B1 | 2/2005 | Hohmann et al. | |
| 6,973,756 | B2 | 12/2005 | Hatzinikolas | |
| 7,654,058 | B2 | 2/2010 | Hatzinikolas | |
| 8,051,621 | B2 | 11/2011 | Hatzinikolas | |
| 8,201,374 | B2 * | 6/2012 | Hohmann, Jr. | 52/379 |
| 8,347,581 | B2 * | 1/2013 | Doerr et al. | 52/700 |
| 8,555,595 | B2 | 10/2013 | Hatzinikolas | |
| 8,667,763 | B2 | 3/2014 | Hatzinikolas | |
| 2002/0014048 | A1 * | 2/2002 | Meendering | E04B 2/8652 52/426 |
| 2003/0150179 | A1 | 8/2003 | Moreno | |
| 2008/0092472 | A1 | 4/2008 | Doerr et al. | |

FOREIGN PATENT DOCUMENTS

| | | | | |
|---|---|---|---|---|
| CA | 1306116 | | 8/1992 | |
| CA | 2102297 | C * | 1/2001 | |
| DE | 19615629 | C1 * | 2/1998 | E04B 1/4178 |
| EP | 120788 | A1 | 10/1984 | |
| EP | 479733 | A1 | 4/1992 | |
| GB | 622156 | A | 4/1948 | |
| GB | 2063329 | A * | 6/1981 | |
| GB | 2161515 | A * | 1/1986 | E04B 1/4178 |
| JP | 05033461 | A | 2/1993 | |
| JP | 05065759 | A | 3/1993 | |
| JP | 05065760 | A | 3/1993 | |
| WO | 9409222 | A1 | 4/1994 | |

* cited by examiner

WALL TIE APPARATUS AND METHOD

This application claims the benefit of priority under 35 USC 120 as a continuation-in-part of U.S. Ser. No. 13/240,930, filed Sep. 22, 2011, itself a division of U.S. Ser. No. 11/554,207 filed Oct. 20, 2006 now U.S. Pat. No. 8,051,621, the specifications thereof being incorporated herein by reference.

FIELD OF THE INVENTION

The invention herein relates to a tie system and method for connecting a veneer, or fronting, to a back-up structure.

BACKGROUND OF THE INVENTION

The various embodiments of apparatus and methods discussed herein relate to a tie system and method for connecting a veneer, or fronting, to a back-up wall. A particular embodiment may relate to a tie system and method for connecting a veneer made from bricks, or siding, or other external presentation material to a backup wall, or structural anchor such as may typically be made from a masonry or cementitious material that is formed using a form made from a penetrable material. The penetrable material of the form may be such a foam material.

Certain types of building incorporate a backup wall that is made from a cementitious material and a veneer that may be made from rows of bricks or the like. The cementitious backup wall is sometimes poured on-site into a form that may be made from slabs of foam material.

Connectors are typically used to secure the veneer to the backup wall. However, these connectors sometimes move out of position during the pouring of the cementitious material that makes up the backup wall, thereby potentially impacting their ability to function as desired. For example, the connector may not be properly positioned to secure the veneer in place once the cementitious material cures.

SUMMARY OF THE INVENTION

In an aspect of the invention there is a tie apparatus. It has a first portion, a second portion and a third portion. The first portion defines an anchor fitting for permanent engagement of wall structure. The second portion defines a web intermediate the first portion and the third portion. The third portion defining a veneer connection interface. The third portion includes an array of indexing fittings, the indexing fittings providing accommodations for form engagement tie retainers.

In a feature of that aspect of the invention the second portion has a lengthwise extent between the first portion and the third portion corresponding to an insulation thickness. In another feature there is a combination of the tie retaining apparatus and a wall form member. The wall form member is formed of thermal insulation material. The wall form member is penetrable by the tie retaining apparatus. The wall form member has a through thickness. On installation the second portion extends through the through-thickness of the thermal insulation member. In use, the indexing fittings locate outwardly proud of the thermal insulation material. In another feature the third portion includes a flange formed thereon most distantly from the first portion. In a further feature, the first portion and the second portion are substantially co-planar, and the flange of the third portion is oriented out-of-plane relative to the first portion and the second portion. In a still further feature, the array of indexing fittings includes at least a first set of indexing members offset from the flange and a second set of indexing members offset from the flange, the first set of indexing members being more offset from the flange than is the second set of indexing members.

In another feature, the second portion is predominantly perforate. In another feature, the second portion is more predominantly perforate than is the first portion. In a further feature, the second portion is perforate, and the second portion is more predominantly perforate than is the first portion. In another feature, the third portion includes a flange formed thereon most distantly from the first portion. In still another feature, the first portion and the second portion are substantially co-planar, and the flange of the third portion is oriented out-of-plane relative to the first portion and the second portion. In another feature, the array of indexing fittings includes at least a first set of indexing members offset from the flange and a second set of indexing members offset from the flange, the first set of indexing members being more offset from the flange than is the second set of indexing members.

In another aspect of the invention there is a tie system for use with a penetrable form for a cementitious backup wall and for use with a wall tie to connect between the cementitious backup wall and a veneer. The tie system has (a) a form connector connectable to a form; (b) a backup wall connector shaped to extend through an aperture in the form and having an inwardly oriented forward-facing form-connector-engagement surface and a rearward-facing form-connector-engagement surface that are positioned to directly engage the form connector to substantially prevent forward and rearward relative movement between the backup wall connector and the form connector; (c) the backup wall connector having an outwardly oriented seat defining an accommodation for the form connector; (d) the accommodation in the form connector also defining a brick-tie engagement fitting; and (e) the form connector being removable from the seat.

In a feature of that aspect there is also a forward-facing wall-tie-engagement surface and a rearward-facing wall-tie-engagement surface. They are positioned to engage a wall tie to substantially prevent forward and rearward relative movement between the wall tie and the backup wall connector. In another feature the forward-facing form-connector-engagement surface is the same as the forward-facing wall-tie-engagement surface, and wherein the rearward-facing form-connector-engagement surface is the same as the rearward-facing wall-tie-engagement surface. In another feature, the backup wall connector has a connector aperture defined by a connector aperture wall, and the connector aperture wall has the forward-facing and rearward-facing wall-tie-engagement surfaces.

In accordance with the instant invention, a system and method are provided to secure a veneer to a backup wall constructed from a pourable material. The system includes a form connector that is securable, and preferably removably securable, to a wall form. In accordance with such an embodiment, the form connector is secured in position and may accordingly be used to secure a backup wall connector in place while the pourable material is curing and, more preferably, until the pourable material is cured, or is at least essentially cured. In a particularly preferred embodiment, the form connector secures the backup wall connector in place while the pourable material is placed, e.g., poured into, the wall form and during at least a sufficient portion of the during process such that the backup wall connector is secured in position by the pourable material.

In another embodiment, a wall tie, which is used to secure a veneer to a backup wall, is connected to the backup wall connector with the form connector in position. In such an embodiment, the form connector remains in position when the veneer wall is installed. In an alternate embodiment, the form connector is removed prior to the veneer wall being installed, thus permitting the form connector to be reused. In an alternate embodiment, the engagement member that is used to secure the form connector to the backup wall connector is also used to secure the wall tie to the form connector. Such an embodiment is particularly preferred in those embodiments wherein the form connector is removed prior to the veneer wall being installed.

Accordingly, in accordance with one embodiment of the instant invention, there is provided a tie system for use with a penetrable form for a cementitious backup wall and for use with a wall tie to connect between the cementitious backup wall and a veneer, the tie system comprising:

(a) a backup wall connector shaped to extend through an aperture in the form and having:

(i) a forward-facing backup-wall-engagement surface and a rearward-facing backup-wall-engagement surface that are positioned to engage the cementitious material when the backup wall connector extends by a selected amount through the aperture in the penetrable form; and, (ii) a forward-facing form-connector-engagement surface and a rearward-facing form-connector-engagement surface that are positioned to engage the form connector to substantially prevent forward and rearward relative movement between the backup wall connector and the form connector;

(b) a tie connector; and, (c) a form connector connectable to the form.

In one embodiment, the tie system further comprises a forward-facing wall-tie-engagement surface and a rearward-facing wall-tie-engagement surface that are positioned to engage the wall tie to substantially prevent forward and rearward relative movement between the wall tie and the backup wall connector.

In another embodiment, the forward-facing form-connector-engagement surface is the same as the forward-facing wall-tie-engagement surface, and wherein the rearward-facing form-connector-engagement surface is the same as the rearward-facing wall-tie-engagement surface. In another embodiment, the backup wall connector has a connector aperture defined by a connector aperture wall, wherein the connector aperture wall comprises the forward-facing and rearward-facing form-connector-engagement surfaces. In another embodiment, the backup wall connector has a connector aperture defined by a connector aperture wall, wherein the connector aperture wall comprises the forward-facing and rearward-facing wall-tie-engagement surfaces. In a further feature, the backup wall connector is a substantially planar plate. In another embodiment, the backup wall connector has at least one opening having a perimeter wall and the forward-facing backup-wall-engagement surface and the rearward-facing backup-wall-engagement surface comprise the perimeter wall.

In another embodiment, the backup wall connector extends other than along a linear axis. For example, the backup wall connector may have an end portion positioned within the cementitious material (when the form is filled) that is bent (e.g. about 90°) of the backup wall connector may be distorted (e.g., S shaped or corrugated) thereby increasing the surface area in contact with the cementitious material and creating a profile the resists the connector from being pulled outwardly from the cured cementitious material.

In another embodiment, the form connector is penetrable to permit a nail to be driven therethrough into the form. In another embodiment, the form connector is made from a material selected from the group consisting of wood and polymeric material. In another embodiment, the backup wall connector is shaped to at least substantially prevent leakage of cementitious material out of the aperture in the form. In another embodiment, the form connector is removable connectable to the form.

In accordance with the instant invention, there is also provided a tie system for use with a penetrable form for a cementitious backup wall comprising cementitious material and for connecting between the cementitious backup wall and a veneer, comprising:

a backup wall connector shaped to extend through the form, the backup wall connector having a length sufficient such that a portion of the backup wall connector is positioned in the cementitious material when the backup wall connector extends by a selected amount through the form and the form is filled, the backup wall connector being configured to inhibit the backup wall connector being pulled outwardly from the cementitious when the cementitious has cured, the backup wall being configured to be engagable with a wall tie; and, a form connector connectable to the form and the backup wall connector.

In another embodiment, the tie system further comprises a wall tie. In another embodiment, the backup wall connector has a connector aperture positioned to engage the form connector to at least substantially prevent forward and rearward relative movement between the backup wall connector and the form connector. In another embodiment, the connector aperture is positioned to engage the wall tie to at least substantially prevent forward and rearward relative movement between the wall tie and the backup wall connector. In another embodiment, the backup wall connector is configured to inhibit the backup wall connector being pulled outwardly from the cementitious when the cementitious has cured by being a substantially planar plate that has at least one aperture in the portion of the backup wall connector that is positioned in the cementitious material. Alternately, the backup wall connector may extend in other than along a linear axis. In another embodiment, the form connector is penetrable to permit a nail to be driven therethrough into the form. In another embodiment, the four' connector is removable connectable to the form.

In accordance with the instant invention, there is also provided a method of securing a veneer to a backup wall comprising:

(a) positioning a backup wall connector to extend through a wall form wherein a first portion of the backup wall connector is positioned within the wall form and a second portion of the backup wall connector is positioned exterior to the wall form, the second portion having a form connector engagement member;

(b) securing a form connector to the wall form and the form connector engagement member; and, (c) attaching a wall tie to the second portion.

In one embodiment, the method further comprises filling the wall form with cementitious material and removing the form connector from the wall form and the form connector engagement member prior to attaching the wall tie to backup wall connector. In another embodiment, the method further comprises constructing the wall form from foam. In another embodiment, the method further comprises filling the wall form with cementitious material and permitting the cementitious material to cure prior to removing the form connector from the wall form. In another embodiment, the method further comprises filling the wall form with cementitious material prior to attaching the wall tie to the second portion. In another embodiment, the method further comprises selecting a backup wall connector wherein the first portion has at least one form-connector-engagement surface.

BRIEF DESCRIPTION OF THE DRAWINGS

For a better understanding of the present invention and to show clearly how it may be carried into effect, reference will now be made, by way of example only, to the accompanying drawings, in which.

DETAILED DESCRIPTION OF THE INVENTION

Figure 1:
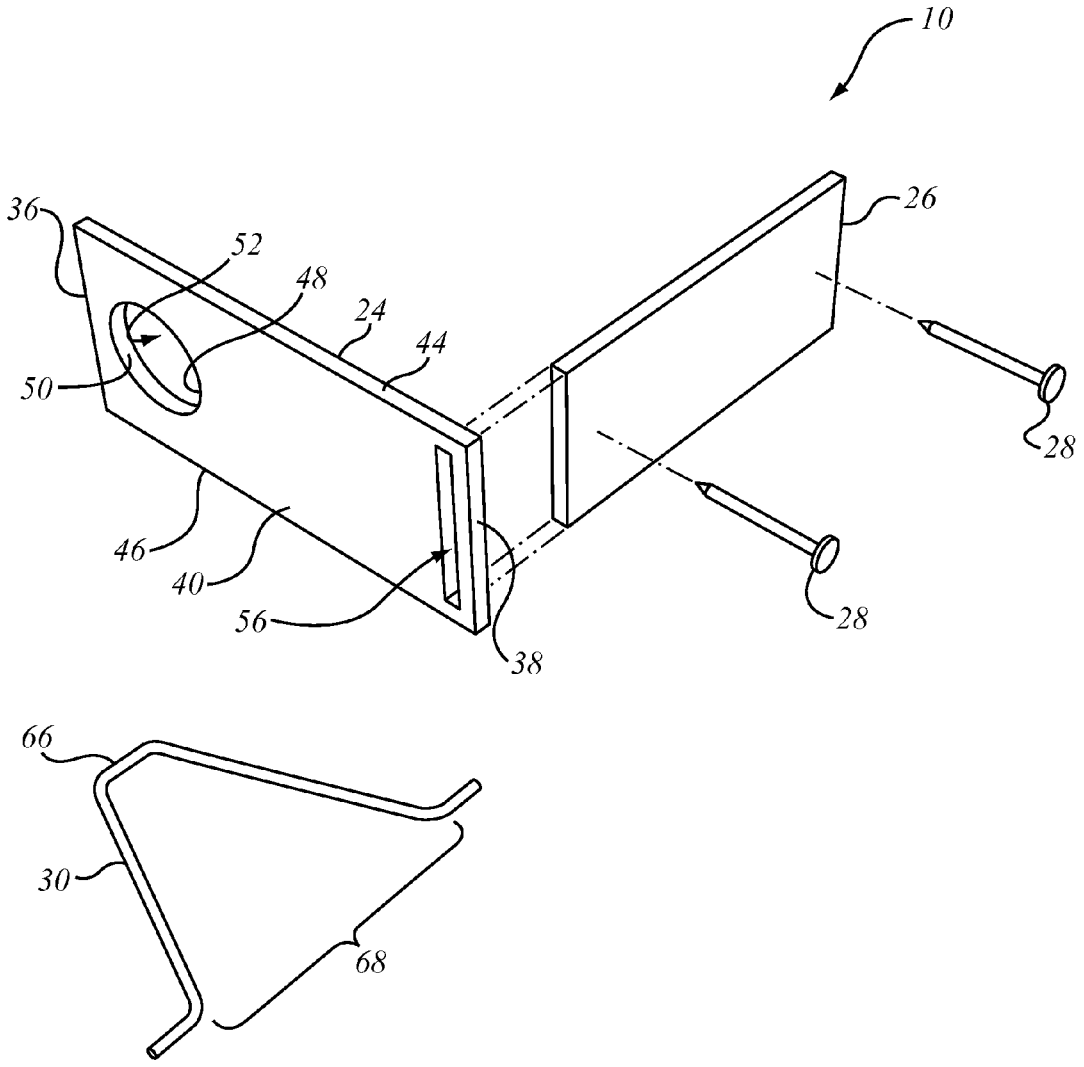
FIG. 1 is a perspective view of the components that make up a tie system in accordance with a first embodiment of the present invention.

The description that follows, and the embodiments described therein, are provided by way of illustration of an example, or examples, of particular embodiments of the principles of the present invention. These examples are provided for the purposes of explanation, and not of limitation, of those principles and of the invention. In the description, like parts are marked throughout the specification and the drawings with the same respective reference numerals. The drawings may be taken as being to scale, or generally proportionate, unless indicated otherwise.

The scope of the invention herein is defined by the claims. Though the claims are supported by the description, they are not limited to any particular example or embodiment, and any claim may encompass processes or apparatus other than the specific examples described below. Other than as indicated in the claims themselves, the claims are not limited to apparatuses or processes having all of the features of any one apparatus or process described below, or to features common to multiple or all of the apparatus described below. It is possible that an apparatus or process described below is not an embodiment of any claimed invention.

The terminology used in this specification is thought to be consistent with the customary and ordinary meanings of those terms as they would be understood by a person of ordinary skill in the art in North America. Following from the decision of the Court of Appeal for the Federal Circuit in *Phillips* v. *AWH Corp.*, the Applicant expressly excludes all interpretations that are inconsistent with this specification, and, in particular, expressly excludes any interpretation of the claims or the language used in this specification such as may be made in the USPTO, or in any other Patent Office, other than those interpretations for which express support can be demonstrated in this specification or in objective evidence of record in accordance with *In re Lee*, (for example, earlier publications by persons not employed by the USPTO or any other Patent Office), demonstrating how the terms are used and understood by persons of ordinary skill in the art, or by way of expert evidence of a person or persons of experience in the art.

A frame of reference may be helpful in understanding the description. In the case of a wall structure, such as may be described herein, a Cartesian co-ordinate system may be applied on the assumption that walls have height and width and through thickness and are generally planar height-wise and width-wise, with the through-thickness of the wall being generally more than an order of magnitude smaller than width or height. Not all walls are planar—walls can be curved or arched. However, in this description whether curved or planar, the wall will be assumed to have a width-wise extent following its surface, and a heighth-wise extent following its surface, and a thickness normal to both height and width. In general, in an insulated wall structure it may be assumed that there is an inside and an outside. The outside may be taken as the side upon which an external facing or veneer may be mounted. In the embodiments described, the z-axis or z-direction may be taken as being the height or heighth-wise direction of the eventual assembly as assembled and installed in a building. In such installation the z-direction would most normally be a vertical axis. The y-direction may be taken as the horizontal direction running along the wall width-wise. In the description, the major faces of the wall, be it inner or outer, may tend to be planar surfaces extending heighth-wise and width-wise in an z-y plane. The x-direction may be taken as the through-thickness direction of the wall panels and of their insulation member components. This co-ordinate system assumes that the wall or wall module, or components thereof, is or are, viewed as finally installed. The terminology is nonetheless somewhat arbitrary and is understood whether the unit is installed or not. The commonly used engineering terms "proud", "flush" and "shy" may be used herein to denote items that, respectively, protrude beyond an adjacent element, are level with an adjacent element, or do not extend as far as an adjacent element, the terms corresponding conceptually to the conditions of "greater than", "equal to" and "less than".

Reference is made herein to insulated members. For the purposes of this discussion a variety of commercially available materials could be used. Unless stated otherwise, it may be taken that the insulation members are made of expanded rigid foam, such as EPS (expanded polystyrene), although other foams could be used, and, subject to the needs of manufacturing processes, a less rigid material might also be employed in some instances.

Reference is made herein to ties and tie plates such as may be installed in masonry walls, whether in poured concrete or in cinder block, or other block walls. For the purposes of this description it may be understood that such ties and plates are most typically made of steel, generally mild steel, which may have been treated to resist corrosion.

FIG. 1 shows an embodiment of tie system, indicated generally as 10. Tie system 10 exemplified in FIG. 1 is used to make a final tie assembly 11, exemplified in FIG. 4, for connecting between a backup wall 12 and a wall of veneer 14 in certain types of structures. The backup wall 12 may be made from a cementitious material 16 that is poured in situ into a form 18 made from slabs of a penetrable material 20 such as a polymeric foam material. It will be appreciated that cementitious material 16 may be any fluid cementitious material 16 known in the building industry to fill a wall form 18. It will also be appreciated that form 18 may be made from any material known in the building industry to construct a wall form 18. The veneer 14 may be made from rows of bricks 22 such as may be face brick, facing stone or the like, which may also be referred to as external facing members or veneer elements 22. It will be appreciated that veneer 14 may be any veneer or facing element known in the building industry that is secured to a support by a wall tie. It is assumed that the external facing element is external, in the sense of being exposed to outdoor climate in terms of temperature, wind, sun, and precipitation, however this need not necessarily be so.

Figure 4:
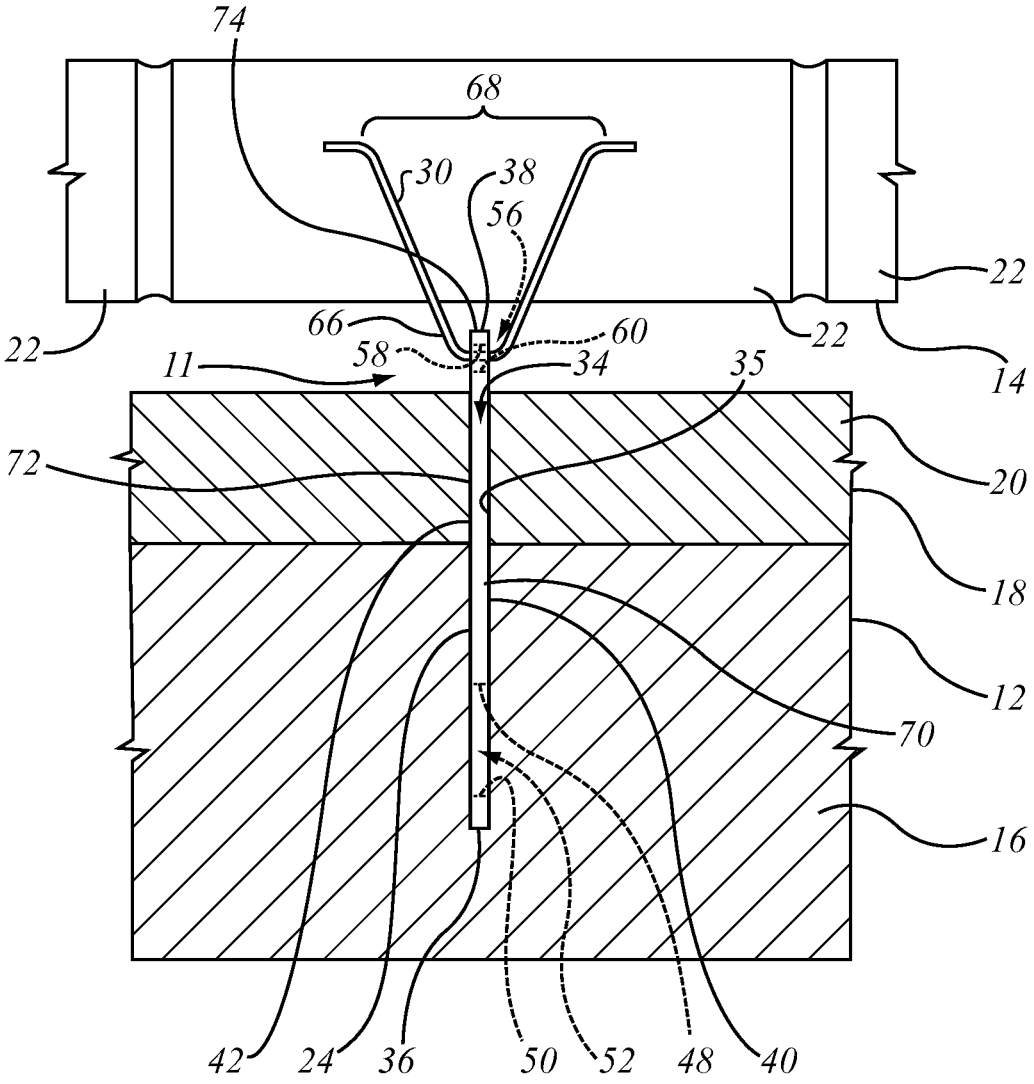
FIG. 4 is a plan view of a final tie assembly made from the components shown in FIG. 1, wherein the final tie assembly connects between the cementitious backup wall shown in FIG. 3 and a veneer.

Referring to FIG. 1, the system 10 includes a backup wall connector 24 for connecting to backup wall 12 (FIG. 4), a form connector 26 for connecting to form 18 (FIG. 4), one or more fasteners 28 for attaching form connector 26 to form 18 (FIG. 4), and a wall tie 30 (FIG. 4).

Figure 2:
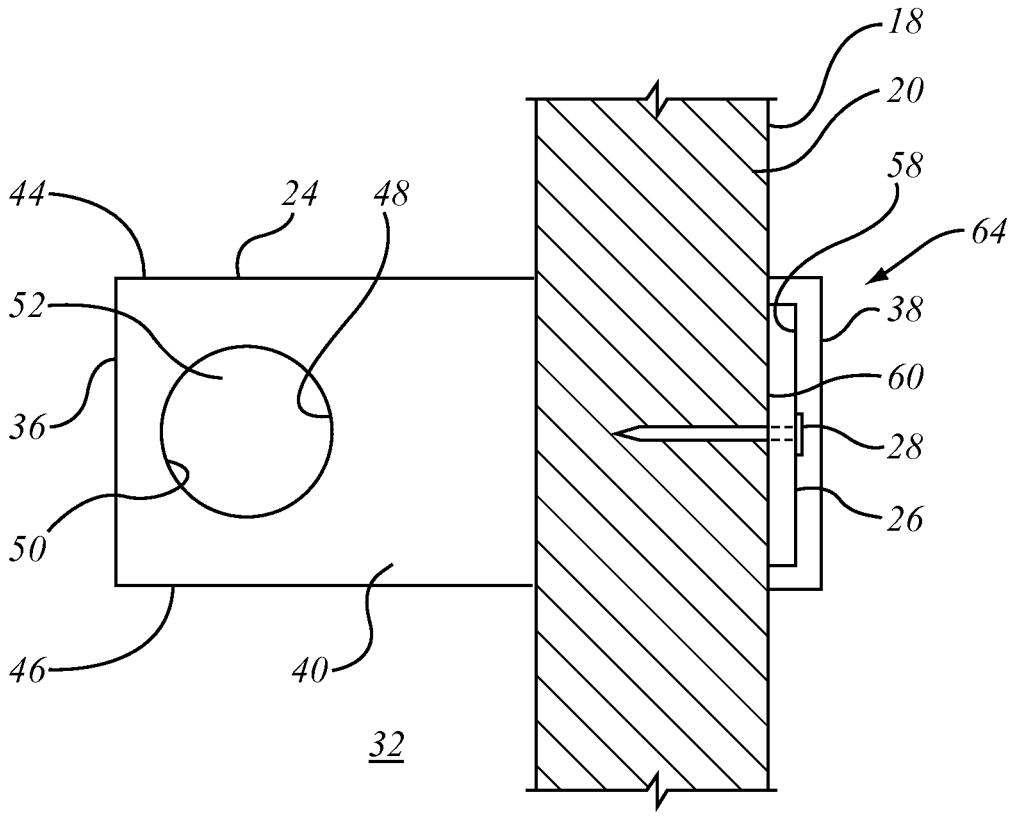
FIG. 2 is a side view of an initial tie assembly made from the components shown in FIG. 1, wherein the initial tie assembly is installed in a form for a cementitious backup wall.

Referring to FIG. 2, backup wall connector 24 extends through (such as by being pushed inwardly through, slid downwardly through or otherwise inserted) form 18 into the space shown at 32 that will receive the cementitious material 16 (see FIG. 3) that will make up backup wall 12 (i.e. the cavity defined by wall form 18). Backup wall connector 24 may typically has a shape that facilitates penetration of form 18. Along a direction of insertion normal to the form in the x-direction, as in the manner of inserting a blade or knife through, for example, a billet of EPS or XPS. For example, backup wall connector 24 may be a generally planar plate (i.e. sides 40 and 42 may be planar) having a length, a width and a thickness, such that the leading edge face (i.e., that penetrates form 18 at forward end 36) may be defined by the width and thickness of the plate. It will be appreciated that backup wall connector 24 may alternately have sides 40 and 42 that are not planar. For example, the section may be L-shaped, or S-shaped, or wavy in corrugations running in the x-direction. In such cases the section may be constant ant may be inserted linearly by translation in the x-direction normal to the form through a slot of corresponding profile. Alternatively, e.g., they may be S-shaped, corrugated or have a portion that extends laterally outwardly (e.g. bent laterally), backup wall connector 24 may be positioned by sliding backup wall connector 24 downwardly into a slot provided in a wall form.

The plate may be made from corrosion resistant steel, or from some other suitable material having a suitable thickness. In this embodiment backup wall connector 24 does not have any flanges or the like extending outwardly from first and second sides 40, 42. That is, to the extent that connector 24 may be substantially planar, as are sides 40, 42, the portions of wall connector 24 that are to be inserted through form 18 do not have out-of-plane features such as might tend complicate insertion in the through thickness direction (i.e., the x-direction normal to the wall surface) As the backup wall connector 24 is inserted through the form 18 (e.g., by hammering it on its rearward end 38), it creates a form aperture 34 (see FIG. 4), which may generally have the cross-section of a slit corresponding to the inward end face of wall connector 24 that has been driven, much like a blade, through the form material. The form material may then tend to form a close fit, perhaps an interference or compression fit about the connector 24. The backup wall connector 24 and the thus formed aperture 34 may tend mutually to seal, in the sense of forming an engagement through which material such as poured concrete may tend not readily to flow. This relationship is shown in at 35 in FIG. 4, an may at least substantially prevent leakage of cementitious material 16 out of the aperture 34 in the form 18 prior to the curing of the cementitious material 16. A preformed aperture may be provided in the wall form.

Figure 3:
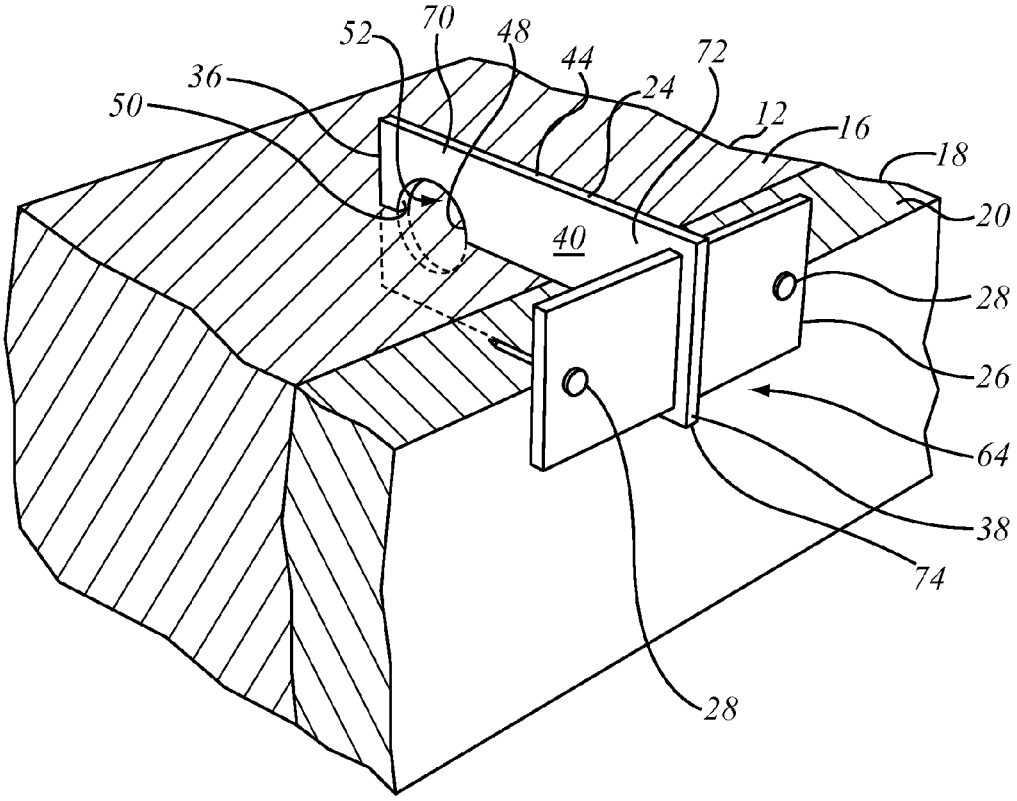
FIG. 3 is a perspective view of the initial tie assembly shown in FIG. 2, shown with the form shown in FIG. 2 and a cementitious backup wall made therein.

A sectional view of backup wall 12 and form 18 are shown in FIG. 3 to facilitate illustration of the structure of backup wall connector 24. Form 18 may be a stay-in-place form. That is, in a conventional poured concrete wall, the forms are removed after curing, and construction proceeds accordingly. Form 18 may be, or may include, a slab or billet of thermal insulation, such as may be made of expanded polystyrene (EPS) or extruded polystyrene board (XPS), or other suitable material. The slab defines a portion of the wall of the form for the poured and cured material, and then, after having performed its one-time forming function, remains in place to forms a portion of the thermal insulation of the wall. The external facing of the wall is then applied outwardly of the insulation.

Referring to back up wall connector 24 exemplified in FIG. 4, back up wall connector 24 has a forward end 36 (which has the leading edge that cuts through thermal insulation form 18), a rearward end 38, a first side 40, a second side 42, an upper margin or edge identified as top 44 (FIG. 2) and a lower edge or margin identified as bottom 46 (FIG. 2). Backup wall connector 24 has additional surfaces to abut against the cured cementitious material to assist in retaining backup wall connector 24 in position in the cured cementitious material.

Referring to FIG. 2, such additional surfaces are provided by providing at least one aperture. As seen in FIG. 2, proximate forward end 36, backup wall connector 24 has a first backup-wall-engagement surface 48 and a second backup-wall-engagement surface 50, both of which are positioned in space 32 so that they are buried in cementitious material 16 of back up wall 12. The first backup-wall-engagement surface 48 is forward-facing in use, and engages cementitious material 16 (FIG. 3) thereby tending to prevent movement of backup wall connector 24 in the forward direction (i.e., into the cementitious material 16). Second surface backup-wall-engagement 50 is rearward-facing and engages cementitious material 16 and may tend to prevent movement of backup wall connector 24 in the rearward direction (i.e., out of the cementitious material 16).

It is not necessary for forward-facing surface 48 to face directly forwardly. Thus, it is not necessary for forward-facing surface 48 to be vertical or to have any portion that is vertical. Forward-facing surface 48 may have any shape that faces forwardly at least somewhat. It may be curved, linear, or a combination of both. Similarly, it is not necessary for rearward-facing surface 50 to face directly rearwardly and therefore it is not necessary for rearward-facing surface 50 to be vertical. That is, the angle of insertion may not be perfectly normal, but may be somewhat oblique either vertically or horizontally. Rearward-facing surface 50 may have any shape that faces rearwardly at least somewhat, and may be curved, linear or a combination of both. Forward facing surface 48 and rearward facing surface 50 may amount to indexing fittings such as may tend, on installation, to inhibit motion in the degree-of-freedom of the direction of insertion. They may be termed two fittings, one inhibiting inward motion in compression, the other inhibiting outward motion in the retraction direction, or they may be referred to as a single fitting performing both functions. They can be considered as a single "anchor" fitting, or as abutment fittings, or as out-of plane-fittings or fitting faces, (i.e., the anchoring face extends transversely to the direction of insertion and retraction although the face may be located between the plane of face 40 and face 42, the point being that, once installed, one way or the other cured wall material forms an x-direction obstruction.

In the embodiment of FIG. 2, the forward-facing and rearward-facing surfaces 48 and 50 are halves of the wall or perimeter of a backup wall connection aperture 52 formed through the thickness of the connector 24 from the first side 40 to the second side 42 (FIG. 3) proximate the forward end 36 of the backup wall connector 24. In the embodiment shown in FIG. 2, the backup wall connection aperture 52 is closed and is generally circular.

Figure 6:
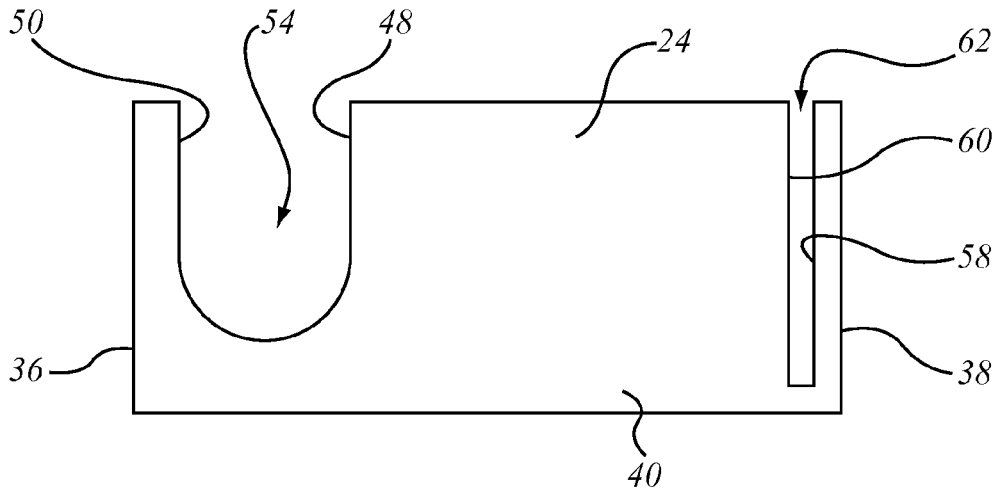

In the embodiment of FIG. 6, forward-facing and rearward-facing surfaces 48 and 50 are halves of a backup wall connection aperture 54 that is U-shaped and is an open-ended slot. The aperture 54 passes through the thickness of the connector 24 from the first side 40 to the second side (not shown in FIG. 6), proximate the forward end 36.

The backup wall connector 24 may have a plurality of forward-facing surfaces 48 instead of one. The backup wall connector 24 may have a plurality of rearward-facing surfaces 50 instead of one. For example, the backup wall connector may have a plurality of apertures and the apertures may be positioned on any portion of backup wall connector 24 that will be positioned in cementitious material 16 when that material 16 is cured.

In a further alternate embodiment, It will be appreciated that backup wall connector 24 may alternately have sides 40 and 42 that are not planar, e.g., they may be S-shaped, corrugated or have a portion that extends laterally outwardly (e.g. bent laterally with respect to the longitudinal axis of backup wall connector 24, i.e. the axis defined by a line passing through forward end 36 and rearward end 38).

Referring to FIG. 1, backup wall connector 24 has a connecting aperture 56 extending therethrough between the first side 40 and the second side 42 (not shown in FIG. 1) proximate rearward end 38. Connecting aperture 56 may be sized snuggly to receive form connector 26 (FIGS. 2 and 3) therethrough when initially connecting the back up wall connector 24 to the form 18. Referring to FIG. 2, connecting aperture 56 has a forward-facing form connector engagement surface 58 and a rearward-facing form connector engagement surface 60. The forward-facing and rearward-facing form connector engagement surfaces 58 and 60 preferably cooperate with form connector 26 to at least substantially prevent the forward and rearward relative movement between backup wall connector 24 and the form connector 26, (and therefore between the backup wall connector 24 and the form 18), when the cementitious material 16 is poured into the space 32. It will be appreciated that, in an alternate embodiment, the form connector 26 may be secured to backup wall connector 24 by other means.

The connecting aperture 56 is preferably sized to concurrently or subsequently (i.e., after form connector 26 is removed) receive the wall tie 30 (FIGS. 4 and 5) therethrough. The wall tie 30 is used to connect the backup wall connector 24 to the veneer 14. In this way, the forward-facing and rearward-facing form connector engagement surfaces 58 and 60 may also be referred to as forward-facing and rearward-facing wall tie engagement surfaces 58 and 60 (see FIG. 4). It will be appreciated that, in an alternate embodiment, the wall tie 30 may be secured to backup wall connector 24 by other means and may be of any construction known in the building industry.

Figure 5:
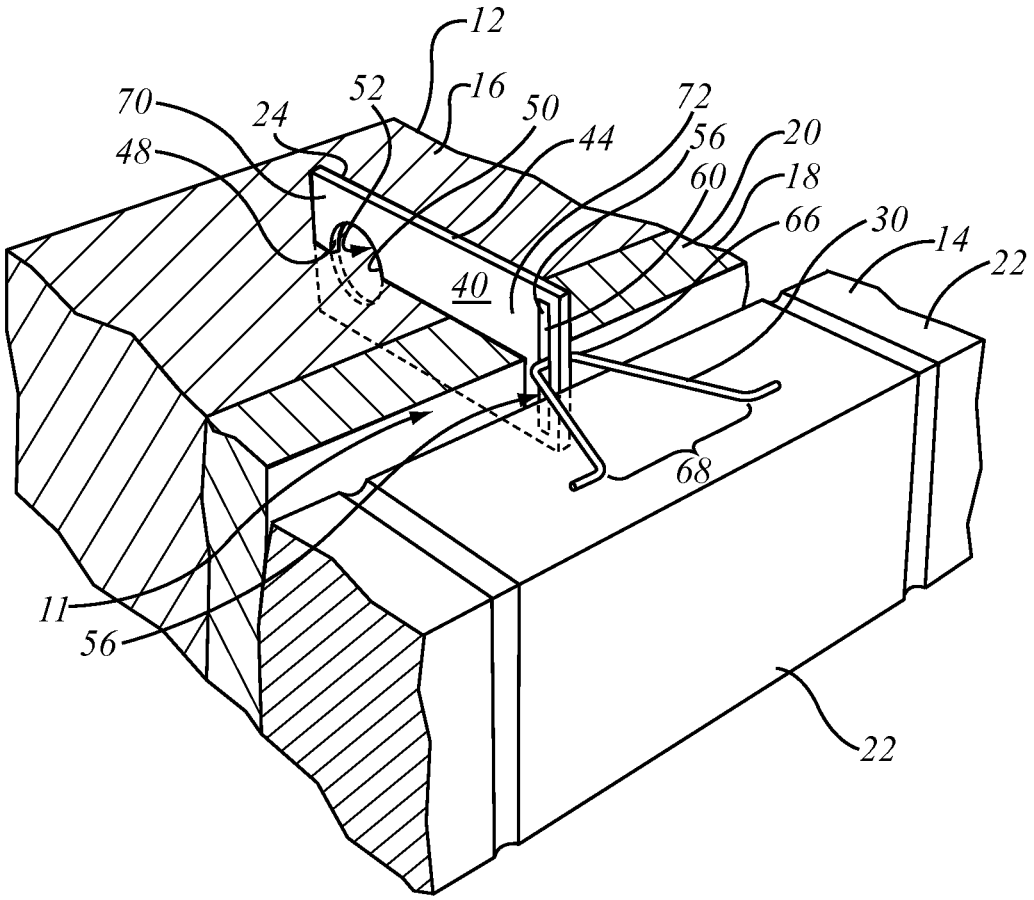
FIG. 5 is a perspective view of the final tie assembly, cementitious backup wall and veneer shown in FIG. 4; and, FIG. 6 is a side view of an alternative backup wall connector to that shown in FIG. 1.

A sectional view of the backup wall 12 and form 18 are shown in FIGS. 4 and 5 to aid in seeing the structure of backup wall connector 24.

Rather than a single connector aperture 56, as shown in FIG. 1, for receiving both the form connector 26 and the wall tie 30, it is alternatively possible to provide a backup wall connector that is not shown in the Figures that includes a separate connector aperture for receiving the form connector 26, and a separate connector aperture for receiving the wall tie 30. In such an alternative, the forward-facing and rearward-facing form connector engagement surfaces of the connector aperture for the form connector may be separate from the forward-facing and rearward-facing wall tie engagement surfaces of the connector aperture for the wall tie. In such an embodiment, form connector 26 may be left in position once the cementitious material cures to a sufficient degree with retain backup connector 24 in position.

The connector aperture 56 is shown in FIG. 1 as being a closed aperture. It is alternatively possible for the backup wall connector 24 to have a connector aperture as shown at 62 in FIG. 6. The connector aperture 62 is open at one end, which facilitates positioning the form connector 26 (FIG. 2) therein and which also facilitates positioning the wall tie 30 (FIG. 4) therein.

Referring to FIG. 2, form connector 26 connects, or retains backup wall connector 24 to, or relative to, form 18 and thereby fixes the position of backup wall connector 24 so that it may tend not to be moved inadvertently, or more than a desired amount, during the pouring and curing of cementitious material 16. Form connector 26 may have any suitable shape, but is preferably planar and generally rectangular for engaging the outside surface of the form. That is, aperture 34 and form connector 26 are co-operating indexing fittings where the as-installed location of aperture 34 establishes a location datum for both the first or interior portion 70 of connector 26 having the anchor or key defined by one or more fittings such as surfaces 48 and 50; for the second or "bridging" portion 72 of connector 26 that, as installed, extends through the thermally insulative member of form 18, for example; and a third outwardly protruding portion 74 that, as installed, stands outwardly proud of the outer surface of form 18. Form connector 26 also establishes a datum, which may in effect be the same datum, since the plane of the inner face of connector 26 may tend to lie flat against the outside face of form 18, thereby tending to cause the inward side of connector aperture 56 to be flush with the outside face of form 18. That relationship also fixes the distance by which the outermost extremity of connector 24, namely rearward end 38, stands outwardly proud of form 18, that distance being indicated as $d_{38}$.

Form connector 26 may be connected to form 18 in any suitable way. For example, form connector 26 may be secured to, and preferably removably secured to, form 18 by fasteners 28 which may be, for example, nails or screws. In this scenario, form connector 26 may be made from a relatively soft material that is relatively easily penetrated by a nail being hammered therethrough. For example, form connector 26 may be made from a polymeric material (e.g., plastic), or wood.

The assembly shown in FIGS. 2 and 3, namely that including backup wall connector 24, form connector 26 and fasteners 28, may be referred to as an initial tie assembly 64.

Referring to FIG. 3, after cementitious material 16 has been poured and has cured sufficiently, fasteners 28 may be removed from form 18 and form connector 26 may be removed from connector aperture 56.

After removal of form connector 26 (FIG. 3) from aperture 56 (FIG. 4), wall tie 30 may be positioned in connector aperture 56. Referring to FIG. 4, wall tie 30 may have any suitable configuration for connecting between backup wall connector 24 and veneer 14. Wall tie 30 may, for example, be a generally V-shaped wire or rod, which has a first, closed end 66 and a second, open end 68.

First end 66 connects to connector aperture 56. Forward-facing and rearward-facing wall tie surfaces 58 and 60 may cooperate with first end 66 to substantially prevent forward and rearward movement between backup wall connector 24 and wall tie 30, and therefore between backup wall connector 24 and veneer 14.

The second end of wall tie 30 connects to veneer 14 in any suitable manner. For example, it may be buried in mortar between adjacent rows of veneer elements 22.

Referring to FIG. 5, connecting aperture 56 may be sufficiently tall to provide some freedom of movement over a selected vertical range for wall tie 30. This permits the height of the wall tie, i.e., the vertical location, to be adjusted to account for variability in the exact height of, e.g., a row of bricks 22 upon which second end 68 of wall tie 30 will rest.

Connecting aperture 56 may be a closed aperture, as shown in FIGS. 1, 2, 3 and 5 such as may tend to reduce or to eliminate risk that wall tie 30 may inadvertently disconnect from backup wall connector 24 in the event that one or both of veneer 14 and backup wall 12 move vertically relative to the other.

Referring to FIGS. 4 and 5, the assembly of backup wall connector 24 and wall tie 30 is a final tie assembly 11.

Penetrable form 18 may be made from a polymeric foam material, such as the foam material that it is used currently in slabs to make a form at certain construction sites. Such foam material is penetrable by means such as a nail or blade. Additionally, such foam material can be left in the erected structure to act as an insulation material. It is alternatively possible, however, to make the form out of some other material that is penetrable by a fastener such as a nail or cutting tool such as a utility saw (of which Skilsaw™ (is one brand) or multi-purpose reciprocating saw (of which the Milwaukee Sawzall™ is a brand).

The structure of backup wall connector 24 may be selected to permit it to be manufactured inexpensively. For example, backup wall connector 24 shown in FIG. 1 may be made simply from a rectangular piece of plate material with two apertures therein (i.e., the aperture 52 and the connector aperture 56), such as by stamping.

The structure of form connector 26 may be selected to permit it to be manufactured inexpensively. For example, the form connector 24 shown in FIG. 1 is simply a rectangular piece of plate material with apertures for fasteners to pass therethrough.

It is possible that tie system 10 (FIG. 1) may be provided without some of the above described components, with the expectation that the user of tie system 10 will acquire those omitted components separately. For example, the fasteners 28 may be omitted from tie system 10 and the user may be expected to provide their own fasteners. As another example, wall tie 30 may be omitted with the expectation that the customer (i.e., the user) will acquire them or will already have a supply of them. Further, form connector 26 may be a reusable member, i.e., it may be removed prior to wall tie 30 being used.

Figure 7:
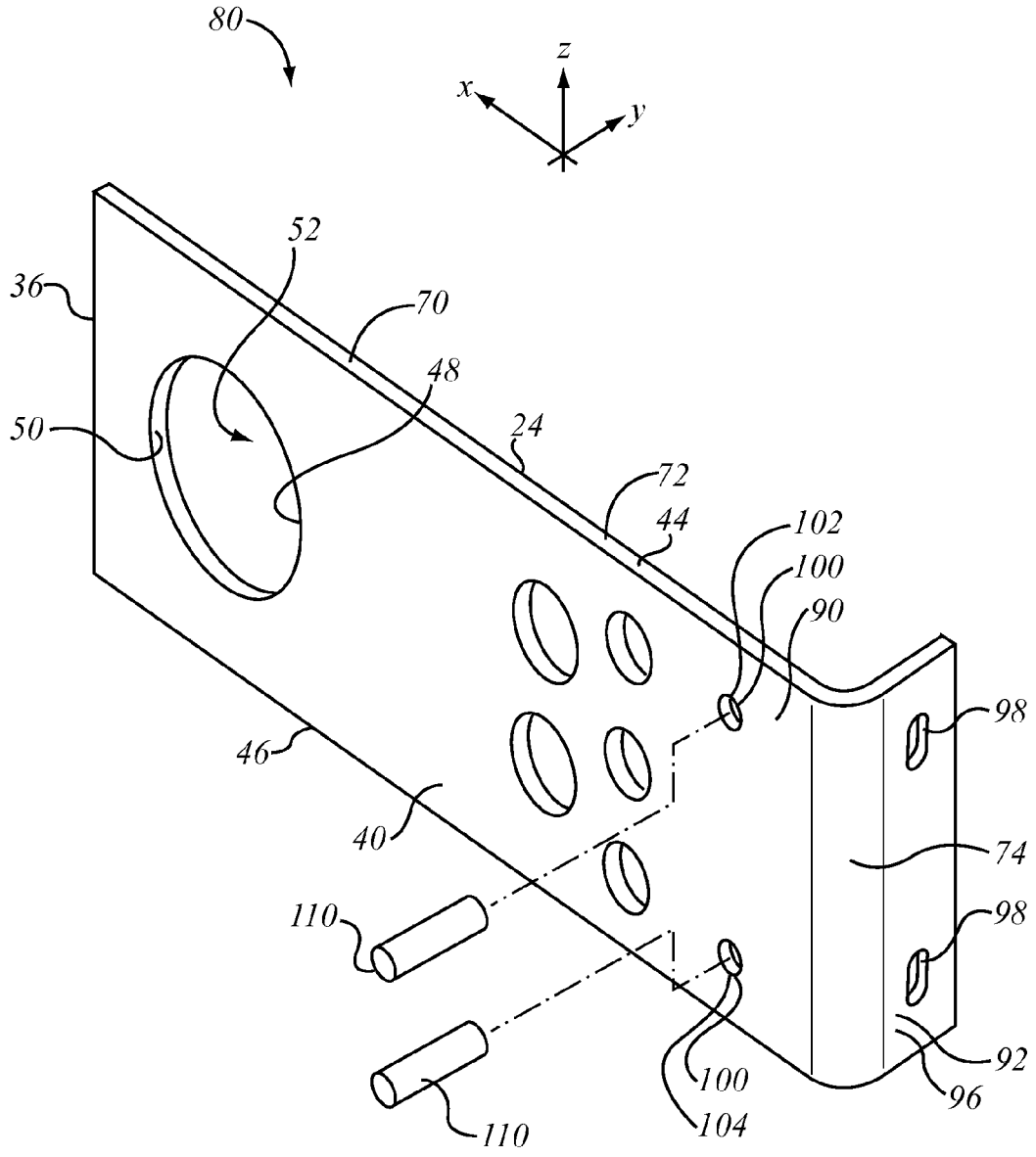
FIG. 7 is a perspective view of an alternative embodiment of tie assembly to that of FIG. 1.

In the embodiment of FIG. 7, a tie apparatus 80, generally similar to backup wall connector 24, may include three portions, namely a first, or innermost portion 82; a second medial or transition portion 84; and a third or outermost portion 86. Medial or transition portion 84 may be located intermediate to, and may form an interconnection of, first portion 82 and third portion 86. As in the embodiments described above, first portion 82 defines or includes a key, or root, embedment fitting, or anchor or anchor fitting, or embedment fitting, however it may be termed, and indicated generally as 88.

As above, anchor fitting 88 may most typically be embedded in poured concrete, and, by its contours, once the concrete is poured define a root that cannot be extracted without bodily extraction of the concrete as well. However, it may be that anchor fitting may be secured to wall structure, be it concrete or steel or other framing structure, and so on by other means, such as threaded fasteners, be they mounted in concrete-anchor threaded seats or by laterally extending threaded fasteners, rivets Huck™ bolts or otherwise. However, the balance of the description will assume concrete embedment. To that end anchor fitting may include such features as apertures 52 or 54, as may be.

Third portion 86 may include a first portion or region 90 and a second portion or member or region 92. First region 90 may be termed the proximate region, because it is proximate to form 18, and is proximate to, and joined to, second portion 84. Second region 92 is the distal region, being more distant from form 18. Second region 92 may be termed more outward than region 90, or conversely, that region 90 is oriented to extend in the inward direction (toward back-up wall 12) relative to region 92.

First region 90 may be substantially planar, and may be co-planar with second portion 84, and may be co-planar with first portion 82. Second region 92 may define an end-fitting, or flange 96. Flange 96 may tend to extend in a plane to which first region 92 is normal, that plane being such that, on installation in form 18, the outside face of flange 96 is generally parallel to, and spaced from, form 18 by a gap distance G. In some embodiments, flange 96 may be provided with pre-formed fastener apertures 98, such as may accept threaded or other fasteners of a facing material, be it some kind of siding, boards, paneling, veneer masonry or a masonry simulacrum, and so on.

First region 90 may have an array of indexing fittings 100. In one embodiment array 100, indexing fittings, or seats, or accommodations, as they may be termed, include an upper aperture 102 and a lower aperture 104, spaced vertically from each other (i.e., as installed). Apertures 102, 104 may be of any shape. However a square, rectangular, round punched or drilled hole may be convenient. In use, the position of tie apparatus 80 may be established relative to the datum of the outside surface of form 18 by the expedient of driving a form connector such as may be a peg, dowel pin, roll pin, cotter pin, rod, shiv, wedge, drift, abutment, plug, dog, or like member 110 there-through such that the inside extremity of the aperture may tend to align with, e.g., be flush with, the outside of form 18, two such dogs 110 being used to encourage connector 80 to run horizontally (as the generally bodily stiffness of e.g., EPS or XPS insulation board may tend also to do). Where a wall tie such as wall tie 30 is to be used, once the wall has cured, one or both of dogs 110 may be knocked out, and tie 30 substituted.

Figure 9:
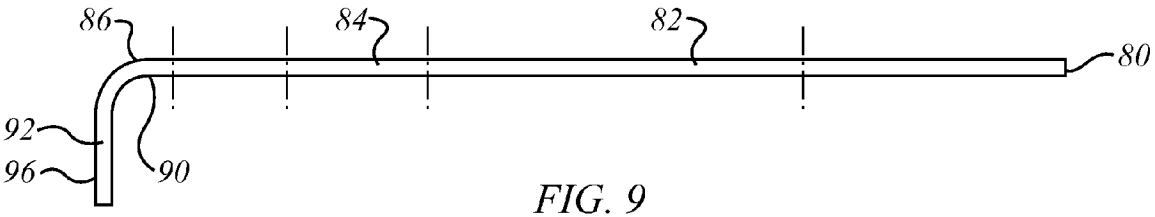
FIG. 9 shows a profile view of the tie assembly of FIG. 7.
Figure 8:
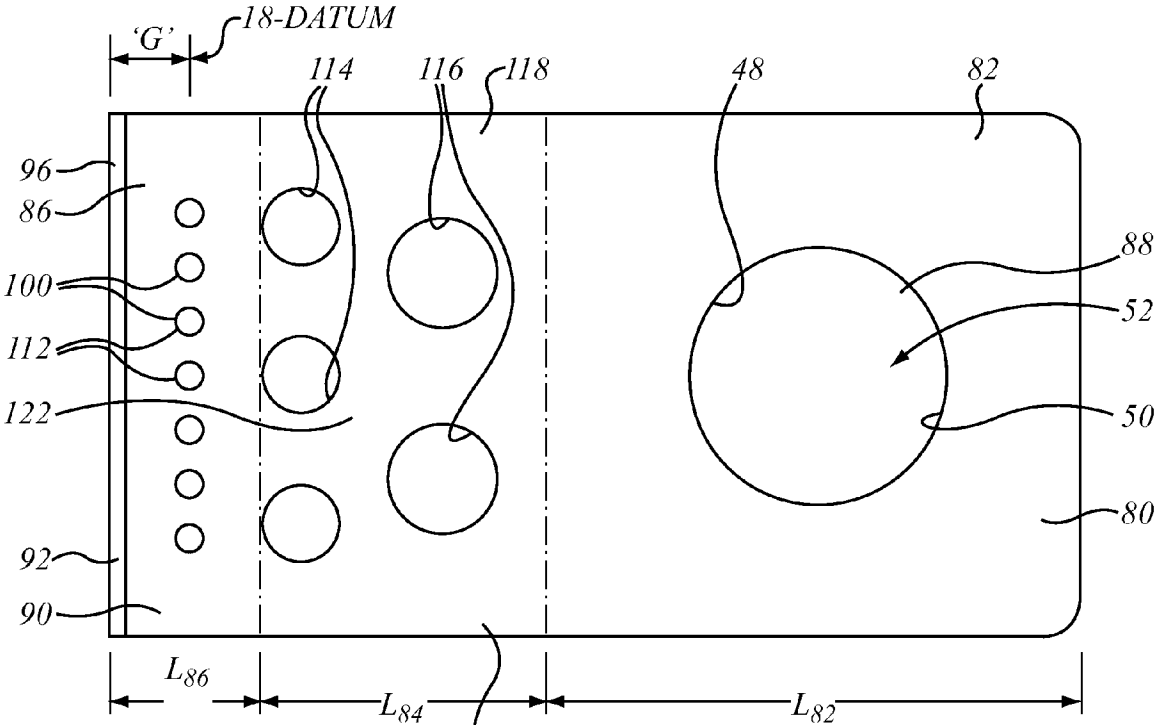
FIG. 8 shows a plan view of the tie assembly of FIG. 7.

In the embodiment of FIGS. 8 and 9, first, second, and third portions 82, 84 and 86 are shown having respective x-direction extents $L_{82}$, $L_{84}$, and $L_{86}$. In this embodiment, array 100 includes a larger number of apertures 112 providing more choice in selection for the appropriate height of brick tie 30. Further, by use of a larger number of apertures, it may be that there may be no need to knock out dogs 110 after curing.

In the embodiments of FIGS. 7-11, it is seen that second portion 84 is perforate. That is, a substantial portion of the section has been removed, such as by means of making a plurality of perforations, such as may tend to reduce heat transfer along apparatus 80 in the x-direction. In FIGS. 7-9, holes 114, 116 may be circular drilled or punched holes, leaving an uninterrupted upper fiber or chord 118, a lower fiber or chord 120, and interstitial connecting regions 122.

Figure 11:
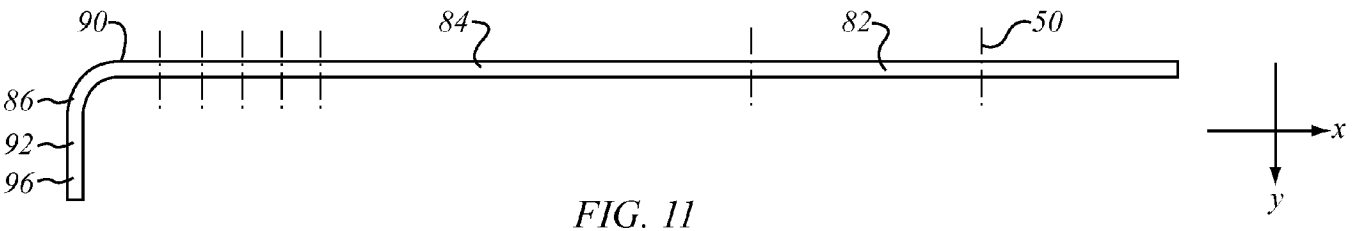
FIG. 11 is a profile view of the tie assembly of FIG. 10.
Figure 10:
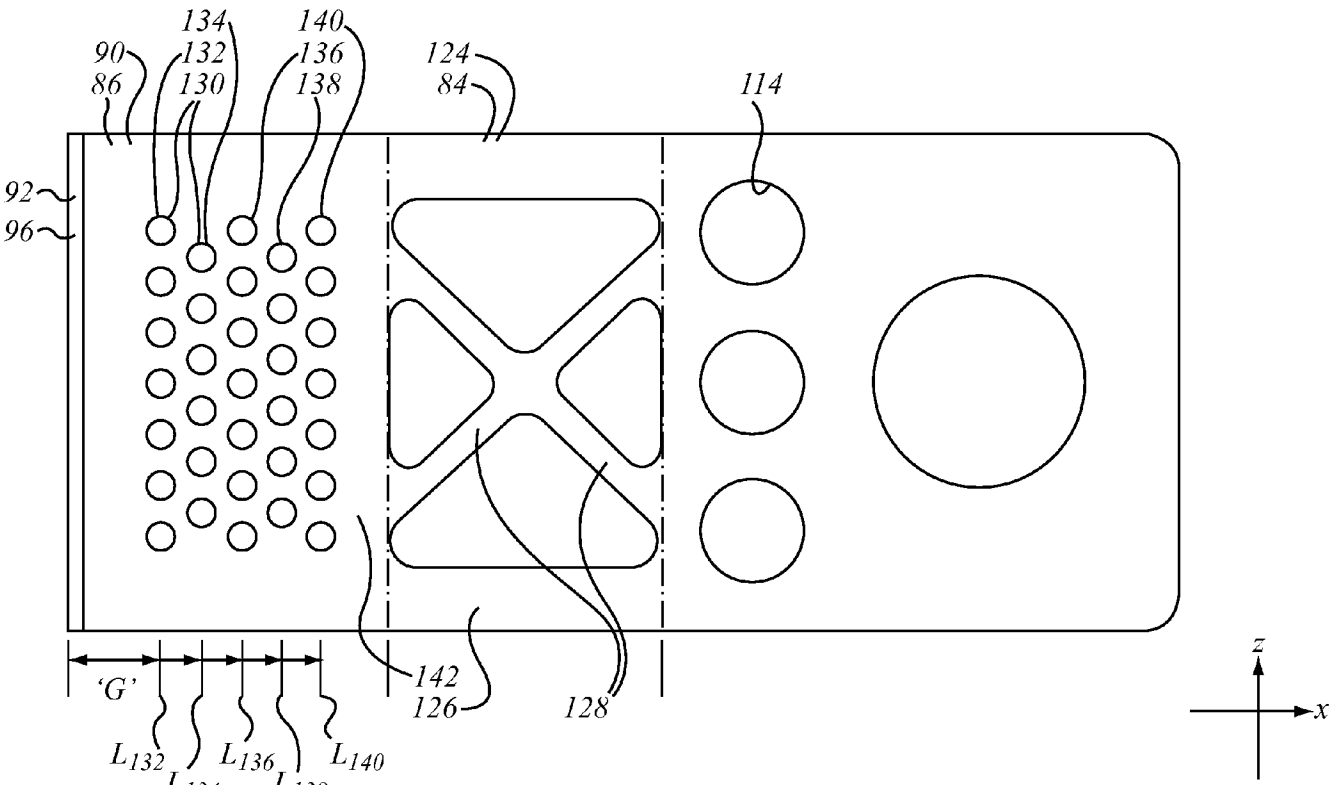
FIG. 10 is a plan view of an alternate tie to that of FIG. 7.

In the embodiment of FIGS. 10-11, second portion 84 includes a top chord 124, a bottom chord 126, and diagonal bracing 128. In these examples the intermediate portion 84 that will, in use, traverse the thermal insulation layer defined by form 18 may tend to have reduced effective cross-sectional area for the purposes of heat transfer. Intermediate portion 84 may then be said to be perforate; may be predominantly perforate; may be more predominantly perforate than first portion 82 in the sense of having a higher percentage of material removed; and, as in the example of FIGS. 7-9, be more perforate, and more predominantly perforate than the third, outward portion 86.

Another feature of the embodiment of FIGS. 10 and 11 is that third portion 86 includes an array of indexing features 130, that includes more than one external air-space gap setting. That is, there is a first vertical set of apertures 132, a second set 134, a third set 136, a fourth set 138 and a fifth set 140. The respective gap spacings are indicated as $G_{132}$, $G_{134}$, $G_{136}$, $G_{138}$ and $G_{140}$. The gap spacing may be on ¼", ⅜", ½", ¼" increments, and so on. They need not be equal spacing, although it may be convenient that they be; and the first spacing, $G_{132}$, may be larger than the others, reflecting a minimum gap. As may be appreciated, there is a solid vertical band of material 142 between array 130 and the perforations of intermediate portion 84. As installed, the "intermediate portion" 84 will be that portion between the set of apertures in which dogs 110 are installed and first portion 82, with the length of second portion 84, $L_{84}$, shifting accordingly. As with the embodiments of FIGS. 7-9, the embodiments may have thermal conduction reduction features, such as section-reducing apertures, or it may have, or it may have multiple sets of gap-depth setting indexing features, or both, and in each case the structure may accept either a brick tie such as brick tie 30, or flange 98 may present a fastening interface at which to secure facing materials, such as their nature may be. Although is may be most common for the apparatus of the various embodiments shown and described herein to be in a vertical plane, as in a poured concrete wall, they may also be employed, as may be suitable, in a horizontal orientation between courses of a block or brick wall.

It will be understood that various modifications and adaptations of the embodiments shown herein can be made without departing from the present invention, the scope of which is defined in the appended claims.

The invention claimed is:

1. A combination of a tie apparatus for a cementitious backup wall, and a wall form member, wherein:

the tie apparatus for the cementitious backup wall includes a backup wall connector having a long leg and a short leg, the short leg defining a flange, said long leg having a first end and a second end, said first end being most distant from said flange, said flange being formed at said second end of said long leg, said flange being bent out-of-plane relative to said long leg, said backup wall connector having a first portion, a second portion and a third portion;

said long leg including said first portion, said first portion including said first end of said long legs said first portion having an anchor fitting defined therein for permanent engagement of wall structure of the cementitious backup wall;

said first portion being shaped to extend through an aperture in a wall form of the cementitious backup wall, and to be embedded in the cementitious backup wall when it is poured;

said long leg including said second portion, said second portion defining a web intermediate said first portion and said third portion;

said third portion having an outward margin that, on installation, is outside and most distant from the cementitious backup wall, said third portion including said short leg;

said flange of said short leg of said third portion defining a veneer connection interface at which directly to attach veneer to the tie apparatus;

said third portion including an array of indexing fittings located in said long leg between said second portion and said second end of said long leg, said indexing fittings of said third portion including at least a first aperture, said indexing fittings providing accommodations sized to receive form connectors, said indexing fittings of said third portion being smaller than said anchor fitting;

whereby said third portion said tie apparatus has both said veneer connection interface, and said array of indexing fittings that provide accommodations for form connectors;

the wall form member is formed of thermal insultation material and has a through-thickness;

the first end of the long leg extends through the wall form member, the second portion being positioned amidst said thermal insulation material;

said second portion being predominantly perforate, and being more predominantly perforate than said first portion, whereby said second portion provides a reduced path for heat transfer between said first portion and said third portion; and on installation, said second portion extending through said through thickness of said thermal insulation material, and, in use, said indexing fittings locating outwardly of said thermal insulation material.

2. The tie apparatus of claim 1 wherein said second portion has a lengthwise extent between said first portion and said third portion corresponding to an insulation thickness.

3. The tie apparatus of claim 1 wherein said first portion and said second portion are substantially co-planar, said third portion includes a web region, said web region being substantially co-planar with said second portion, said indexing fittings including a plurality of apertures passing through said web region, said plurality of apertures including said first aperture, and said flange of said third portion is oriented out-of-plane relative to said web region; said plurality of apertures of said web region present seats in which to introduce either of a brick tie and a form connector, and said flange presents a surface against which to fasten veneer.

4. The tie apparatus according to claim 3 wherein said array of indexing fittings includes at least a first set of indexing members offset away from said flange toward said second portion, and a second set of indexing members offset away from said flange toward said second portion, said first set of indexing members being more offset away from said flange than is said second set of indexing members.

5. The tie apparatus of claim 1 wherein said array of indexing fittings includes at least a first set of indexing members offset from said. flange and a second set of indexing members offset from said flange, said first set of indexing members being more offset from said flange than is said second set of indexing members.

6. The tie apparatus of claim 1 wherein said anchor fitting includes a first aperture and said first aperture has a closed circular periphery.

7. The tie apparatus of claim 6 wherein said first portion and said second portion are substantially co-planar, said third portion includes a web region, said web region being substantially coplanar with said second portion, said indexing fittings including a plurality of apertures passing through said web region, said plurality of apertures including a second aperture, said second aperture having a smaller diameter than said first aperture.

8. A tie system for use with a penetrable form for a cementitious backup wall, the tie system comprising:

(a) a form connector connectable to a form;

(b) a backup wall connector that has a first portion that includes a first end that fits through an aperture in the form, and that has a first aperture formed in said first end to admit cementitions material therethrough said first aperture defining an embedment anchor to be held in the cementitious material, the backup wall connector having a second end having an outward margin that is most distant from said said first end;

(c) said backup wall connector has a second portion connected to said first portion, and a third, portion connected to said second portion, said second portion being between said first portion and said third portion;

(d) said third portion of the backup wall connector having an array of seats, said array of seats defining a selection of form connector accommodations distant from said first portion, and said form connector being selectively seatable therein;

(e) the selection of accommodations in said backup wall, connector also defining brick tie engagement fittings, said brick tie engagement fittings being smaller than said first aperture, said brick tie engagement fittings including ones thereof located at a selection of distances from said outward margin, and at a selection of heights at each distance of said selection of distances;

(f) said second portion having perforations therein, said perforations of said second portion being smaller than said first aperture; and (g) said form connector being removable; and (h) there are two said form connectors, and said array of seats defines accommodations in which to receive said two form connectors, and when, so received said seats prevent forward and rearward relative movement between the form connectors and the backup wall connector.

9. The tie system or claim 8 wherein said second portion is predominantly perforate.

10. The tie system of claim 8 wherein said second portion is more predominantly perforate than is said first portion.

11. The tie system of claim 8 wherein:

said first portion and said, second portion are substantially co-planar;

said third portion includes a web region and a flange mounted to said web region distant from said second, portion;

said web region being substantially co-planar with said first portion and said second portion, and including said indexing fittings; and said flange extending out-of-plane cross-wise to said web region.

12. A tie system as claimed in claim 8 wherein:

said third portion includes a web region and a flange mounted to said web region distant from said second porton;

said flange extends in a plane substantially perpendicular to said first and second portions, said flange presenting an attachment surface to which the veneer can be mechanically fastened.

13. A tie system as claimed in claim 8, wherein said array of seats defines accommodations in which to receive said form connectors and a brick tie at the same time.

14. A tie system as claimed in claim 8, wherein:

the backup wall connector has a first portion defining an embedment anchor to beheld in the cementitious material, said embedment anchor including said first aperture;

the backup wall connector has a second portion adjoining said first portion, said second portion being perforated to reduce heat transfer therealong; and the backup wall connector has a third portion, said third portion including said array of seats.

15. A tie system as claimed in claim 8 wherein said backup wall connector has a flange at said outward margin, said flange defining an alternate interface at which mechanically to fasten a veneer.

16. The tie system of claim 8 wherein said first aperture has a closed circular periphery.

17. A tie system as claimed in claim 14 wherein said backup wall connector has a flange at said outward margin, said flange defining an alternate interface at which mechanically to fasten a veneer.

18. The tie system of claim 8 in combination with a form for the cementitious backup wall, said third portion of said backup wall connector includes a bent flange defining a short leg of said backup wall connector, the form having an inside and an outside; said tie system being mounted to said form, and when so mounted, said long leg first and second portions extending through said form and said short leg of said backup wall connector being located outwardly of said form.

* * * * *